US006149212A

United States Patent [19]

Kuntz et al.

[11] Patent Number: 6,149,212

[45] Date of Patent: Nov. 21, 2000

[54] ADJUSTABLE DOOR STOP

[75] Inventors: William Kuntz, Rehoboth Beach, Del.; George William Bohle, Jr., Baltimore, Md.

[73] Assignee: Eagle Inventors, LLC, Rehoboth Beach, Del.

[21] Appl. No.: 09/201,809

[22] Filed: Dec. 1, 1998

Related U.S. Application Data

[63] Continuation-in-part of application No. 08/887,297, Jul. 2, 1997, abandoned.

[51] Int. Cl.[7] ..... E05C 19/18

[52] U.S. Cl. ..... 292/288; 292/DIG. 17; 16/82

[58] Field of Search ..... 292/338, 339, 292/342, 343, DIG. 17, 288; 49/394, 383; 16/374, 82

[56] References Cited

U.S. PATENT DOCUMENTS

| | | |
|---|---|---|
| D. 286,015 | 10/1986 | Johnson . |
| D. 323,976 | 2/1992 | Barnes . |
| 375,394 | 12/1887 | Strachan . |
| 1,635,566 | 7/1927 | Victorsohn . |
| 1,903,251 | 3/1933 | Ahrens . |
| 1,910,883 | 3/1933 | Caroselli . |
| 2,201,594 | 5/1940 | Sitts . |
| 2,592,230 | 4/1952 | Allen . |
| 2,799,888 | 7/1957 | White . |
| 2,813,293 | 11/1957 | Civitelli . |
| 2,827,951 | 3/1958 | Herider et al. . |
| 3,174,179 | 3/1965 | Benson . |
| 3,579,712 | 5/1971 | Smith . |
| 3,758,141 | 9/1973 | Weinberger . |
| 3,811,150 | 5/1974 | Chalmers . |
| 3,913,171 | 10/1975 | Reid . |
| 4,436,331 | 3/1984 | Glickman et al. . |
| 4,527,303 | 7/1985 | Civitelli . |
| 4,792,168 | 12/1988 | Kardosh ..... 292/288 |
| 4,831,688 | 5/1989 | Deininger . |
| 4,998,941 | 3/1991 | Smith . |
| 5,027,471 | 7/1991 | Barnes . |
| 5,044,681 | 9/1991 | Neighbors . |
| 5,098,142 | 3/1992 | Fontenot . |
| 5,265,922 | 11/1993 | Falcone . |
| 5,450,652 | 9/1995 | Webb . |
| 5,473,841 | 12/1995 | Grillo . |
| 5,511,837 | 4/1996 | Dempsey et al. . |
| 5,581,844 | 12/1996 | Reheb et al. . |

*Primary Examiner*—B. Dayoan
*Assistant Examiner*—Gary Estremsky
*Attorney, Agent, or Firm*—Sterne, Kessler, Goldstein & Fox P.L.L.C.

[57] ABSTRACT

An adjustable door stop that enables a hinged door to be propped open at any desired angle relative to the frame to which the door is mounted. Alternatively, the device enables a door to be securely closed, thereby operating as a lock. The device comprises a substantially cylinder-like structure placed over or otherwise mounted to a door hinge. An arcuate inner chamber is disposed and freely moves within the substantially hollow interior of an arcuate outer chamber. Various angular orientations are obtained by selectively aligning the inner chamber with the outer chamber. The chambers are held in their respective positions by activating a locking member disposed on the door stop.

10 Claims, 2 Drawing Sheets

ADJUSTABLE DOOR STOP

REFERENCE TO RELATED APPLICATION

This application is a Continuation-in-Part of Application Ser. No. 08/887,297; filed Jul. 2, 1997 now abandoned, the disclosure of which is incorporated in its entirety by reference hereto.

FIELD OF THE INVENTION

This invention relates generally to an adjustable door stop, and more particularly to a device which enables a hinged door to be propped open at any desired angle. Alternatively, the device enables a door to be securely closed, thereby operating as a type of lock. The device enjoys universal application to any door which pivots about an axis, particularly a vertical axis.

BACKGROUND OF THE INVENTION

A traditional or conventional door serves many important functions. In a residence, for example, doors may provide security to prevent unauthorized entrance into the residence, or a particular room thereof. Doors also provide privacy, preventing undesired intrusions by other people, and by muffling or damping noises from the outside world. Doors also contribute to energy efficiency, by preventing the unwanted entrance or escape of cold air, heat, etc.

The foregoing are clearly but a few of the many functions which a door may serve. Equally obvious is that numerous factors may impact the particular structure or form a door will take. Such factors include, but are not limited to, the intended use of the door, the object of which the door forms a part (i.e., home, office, car, refrigerator, barn, etc.), and the location on the object where the door is disposed (i.e., front or back door, bathroom, closet, fuse box, etc.).

Irrespective of such factors, by its very nature every door is intended to be opened. Indeed, when considerations such as privacy are not paramount, it is often preferred that doors remain open. Open doors within homes and offices encourage social and professional interaction, promote air circulation, and contribute to feelings of well-being and community which are fostered by open, airy spaces.

Because most doors are hinged or otherwise pivot about an axis, however, a recurring problem is how to ensure that doors remain open. Factors such as wind, spring tension, or well-intentioned individuals can close doors which are intended to remain open. For example, many doors are equipped with spring-loaded or similar type tension means, whereby the door is automatically urged back to its closed position after opening. While this is an often-times attractive feature which saves effort and adds to security, such doors are also a nuisance, particularly when an individual wishes to repeatedly enter and exit a room in a short amount of time (such as when moving furniture in or out of the room). The present invention will effectively override such tension means, and hold the door open until the user truly wants the door to remain closed.

In addition to being disconcerting, the unexpected closing of a door can also pose safety hazards. For example, the door may lock unintentionally when closed, or unsuspecting individuals (particularly children and the elderly) and pets may get caught in the closing door.

In light of the above, the need exists for a door "stop", "prop" or "jam" which enables a door to be retained in an open or closed position in a secure, safe and effective manner.

It is, therefore, an object of the present invention to provide a door stop which securely retains a door in an open or closed position.

It is a further object of the present invention to provide a door stop which is adjustable, such that a door may be held open at any one of a number of different angles relative to the frame to which the door is mounted.

It is a further object of the present invention to provide a door stop which is adjustable such that a door may be opened only a limited amount.

It is a further object of the present invention to provide a door stop which may act as a primary or secondary lock, securely retaining the door in a fully or partially closed position.

It is a further object of the present invention to provide a door stop which is attractive in use.

It is a further object of the present invention to provide a door stop which is easy to manufacture.

It is a further object of the present invention to provide a door stop which is affordable and inexpensive.

It is a further object of the present invention to provide a door stop which will not harm corresponding structure such as walls and doors.

It is a further object of the present invention to provide a door stop which may be mounted on either side of a door.

It is a further object of the present invention to provide a door stop which is out of the way when in use and which does not rest upon the floor.

SUMMARY OF THE INVENTION

To achieve the foregoing and other objects, and in accordance with the purposes of the present invention, as embodied and broadly described herein, the present invention comprises an adjustable door stop. The door stop includes an outer chamber having a substantially hollow interior defined by a top surface, a bottom surface, a substantially arcuate outer surface, a substantially arcuate inner surface, and a first end and a second end connecting the outer and inner surfaces. An inner chamber is at least partially disposed within the interior of the outer chamber, and includes a top surface, a bottom surface, a substantially arcuate outer surface, a substantially arcuate inner surface, and first and second ends connecting the outer and inner surfaces. The inner chamber has freedom of movement within the interior of the outer chamber, and various angular orientations of a door may be obtained by selectively aligning the inner chamber with the outer chamber.

Complimentary adjustment means may be disposed on the top surfaces of the outer and inner chambers. A plurality of apertures may be formed in the top surfaces of one or both of the outer and inner chambers. A locking member may extend through the apertures of one or both of the top surfaces of the outer and inner chambers. A mounting member, which may comprise a substantially hollow sleeve for receiving a door hinge, may extend from the door stop. The first and second ends of the outer chamber may form an approximately 90° angle.

Alternatively, the present invention comprises an adjustable door stop comprising an outer chamber having a substantially hollow interior defined by a top surface having a plurality of apertures formed therein, a bottom surface, a substantially arcuate outer surface, a substantially arcuate inner surface offset from the outer surface, and first and second ends connecting the outer and inner surfaces. An inner chamber is at least partially disposed within the hollow interior of the outer chamber. The inner chamber includes a top surface having a plurality of apertures formed therein, a bottom surface, a substantially arcuate outer surface, a substantially arcuate inner surface offset from the outer surface, and first and second ends connecting the outer and inner surfaces. A locking member is disposed within and extends through at least one aperture of each of the top surfaces of the outer and inner chambers.

BRIEF DESCRIPTION OF THE FIGURES

The accompanying drawings, which are incorporated in and form part of the specification, illustrate an embodiment of the present invention and, together with the description, serve to explain the principles of the invention. In the drawings.

DETAILED DESCRIPTION OF THE PREFERRED EMBODIMENTS

Reference will be made in detail below to the preferred embodiment of the present invention illustrated in the accompanying drawings. It should be noted that similar or identical structure is identified using identical reference numbers.

Figure 1:
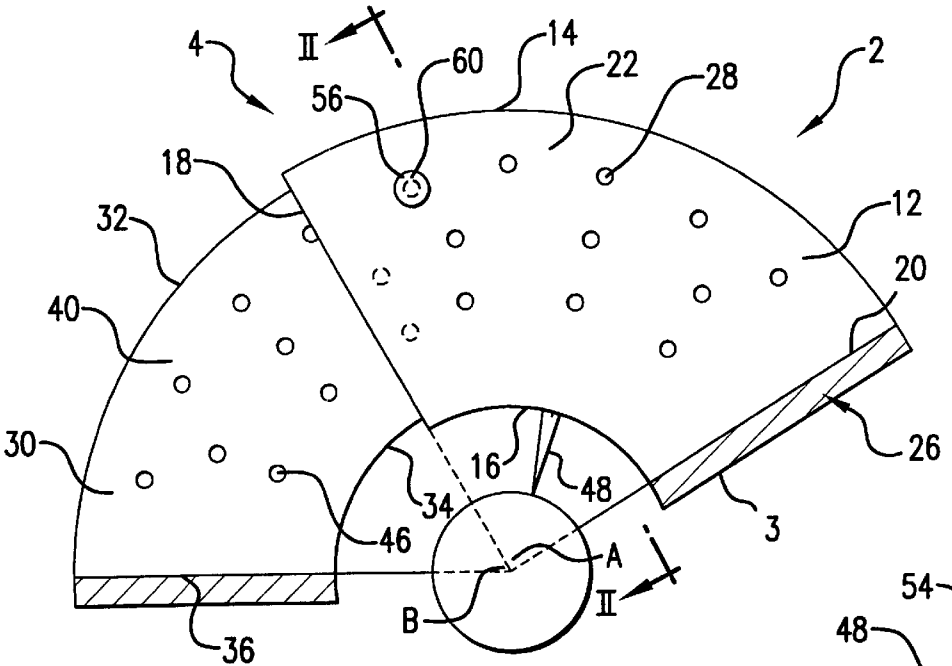
FIG. 1 is a top plan view of a unit in accordance with the adjustable door stop of the present invention, wherein the inner chamber of the door stop is partially received within the outer chamber thereof.

Referring now to the preferred embodiment, a top plan view of an adjustable door stop in accordance with the present invention is shown generally at 2 in FIG. 1. Door stop 2 may be made of virtually any material, and is preferably formed of a strong metal or plastic material. Such material should be sufficiently strong to prevent bending or cracking and to otherwise bear the stresses present when pressure is placed upon the door to which door stop 2 corresponds. Door stop 2 may be made in part or in whole of an attractive material such as brass, and may include decoration or ornamentation, in order that door stop 2 may form part of a pleasing decor. Door stop 2 may also be of a color or texture which compliments the associated door frame and surrounding structure.

Door stop 2 is a substantially arcuate, partial cylinder-like structure mounted directly to or adjacent a door hinge. Door stop 2 comprises a unit 4 including an outer chamber 12 and an inner chamber 30. In FIG. 1, inner chamber 30 is shown partially received by and disposed within outer chamber 12. Outer chamber 12 includes an arcuate outer surface 14 and an arcuate inner surface 16 offset from outer surface 14. A first end 18 and a second end 20 connect outer and inner surfaces 12, 14. First and/or second ends 18, 20 may be padded, such as with a rubber, foam or cloth material, in order to prevent any scratches, indentations or similar marks from appearing on the corresponding door, 3 wall or similar structure.

Figure 2:
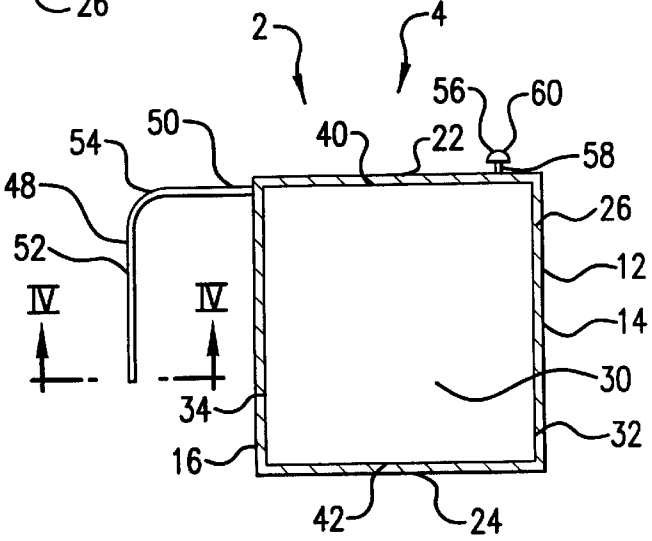
FIG. 2 is a cross-sectional view taken along line II—II of FIG. 1.
Figure 4:
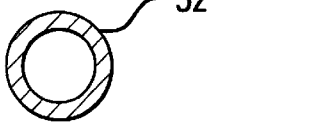
FIG. 4 is a cross-sectional view taken along line IV—IV of FIG. 2.

Outer chamber 12 is further defined by a top surface 22 and a bottom surface 24 (see FIG. 2). Adjustment means comprising a plurality of apertures 28 are formed within top surface 22, and preferably extend completely therethrough. As discussed below, apertures 28 contribute to the adjustability of door stop 2, such that a door may be secured and retained at various angles relative to the frame to which it is mounted. Together, outer and inner surfaces 14, 16, first and second ends 18, 20, and top and bottom surfaces 22, 24 define a substantially hollow interior 26 of outer chamber 12.

Inner chamber 30 is similar in structure to outer chamber 12. In this regard, inner chamber 30 includes an arcuate outer surface 32 and an arcuate inner surface 34 offset from outer surface 32. A first end 36 and a second end 38 connect outer and inner surfaces 32, 34. First and/or second ends 36, 38 may be padded in order to prevent any damage from occurring to the surrounding structure.

Inner chamber 30 is further defined by a top surface 40 and a bottom surface 42. Adjustment means comprising a plurality of apertures 46 are formed within top surface 40, and preferably extend completely therethrough. Inner chamber apertures 46 are shown arrayed in the same number and pattern as outer chamber apertures 28. As discussed below, inner chamber apertures 46, in conjunction with outer chamber apertures 28, permit door stop 2 to be adjusted such that a door may be retained at various positions. Inner chamber 30 may be of a substantially hollow construction similar to outer chamber 12 or, alternatively, may be formed of a substantially solid construction.

Preferably, door stop 2 is approximately 3–6 inches in height (i.e., between top and bottom surfaces 22, 24 of outer chamber 12). However, door stop 2 will effectively perform its desired function no matter what its dimensions. For example, door stop 2 may comprise an elongated, pole-like structure extending throughout the height of the door to which it corresponds. In such an embodiment, the entire door stop may be ornamented and comprise door "treatment" which contributes to a pleasing decor.

Referring to FIGS. 1 and 2, a mounting member 48 is shown extending from outer chamber 12 adjacent the area where top surface 22 and inner surface 16 merge. Mounting member 48 comprises a substantially horizontal first arm 50 and a substantially vertical second arm 52 depending from first arm 50. First and second arms 50, 52 merge adjacent a central portion 54.

Mounting member 48 is adapted to be placed over or otherwise engage a door hinge. In this regard, it is preferred that at least second arm 52 of mounting member 48 comprise a substantial hollow sleeve. Mounting member 48 may be slidingly and downwardly engaged upon a door hinge, such that the central pin of the door hinge is received within second arm 52 until it reaches central portion 54 of mounting member 48. Door stop 2 thus effectively hangs from the door hinge, and is easily placed upon and removed from the hinge. Mounting member 48 should be sufficiently slender so as not to be readily detectable, nor interfere with the desired rotation of the door or prevent the complete closure of the door.

An important feature of the door stop of the present invention is the adjustability thereof. Referring to FIGS. 1 and 2, inner chamber 30 of unit 4 is of slightly smaller dimensions than outer chamber 12, such that inner chamber 30 may be readily received within the substantially hollow interior 26 of outer chamber 12. In light of their comparative dimensions, inner chamber 30 has freedom of generally lateral movement within outer chamber 12, when one or both of chambers 12, 30 is moved (such as in a sliding or rotating manner) with respect to the other.

In order to retain a door in the desired angular position, one or both of chambers 12, 30 is moved until selected apertures 28 of top surface 22 of outer chamber 12 are aligned with selected apertures 46 of top surface 40 of inner chamber 30. In light of the plurality of apertures formed within both outer chamber 12 and inner chamber 30, it will appreciated that a myriad of potential combinations (and thus angular positions) is possible.

Once the desired position is established, a locking member 56 is placed through at least one outer chamber aperture 28, and the corresponding inner chamber aperture 46 disposed directly beneath it. Locking member 56 preferably comprises a pin-like structure having a narrow body 58 and a head 60 which is larger in diameter than at least outer chamber apertures 28. A conventional bolt with a hexagonal head is but one possible structure for locking member 56. For stability and security, it is preferred that more than one locking member 56 be used; for example, three locking members 56 may be used simultaneously, one each through three outer chamber apertures 28 and their corresponding inner chamber apertures 46. Locking members 56 help securely retain the door in the desired position by precluding further lateral movement of inner chamber 30 within outer chamber 12.

Depending upon which side of a door the present invention is placed, door stop 2 will either prop the door open at the desired angle, or prevent the door from opening beyond the desired angular position relative to the frame to which the door is hingedly mounted. In this regard, assuming the door stop 2 of FIG. 1 were to be placed adjacent the interior of an opened door, second end 20 of outer chamber 12 may rest against the door, while first end 36 of inner chamber 30 may rest against the door frame, molding or adjacent wall structure.

In addition to the various door positions which may be obtained by aligning different combinations of apertures 28, 46, differing positions may also be obtained by using door stop units of varying shapes and sizes. For example, FIG. 1 shows a "90°" unit 4, in that the angle A formed by the hypothetical intersection of first end 18 and second end 20 of outer chamber 12 is approximately 90°. Unit 4 is shown in FIG. 1 in a fully extended position, such that the angle B formed by the intersection of first end 36 of inner chamber 30 and second end 20 of outer chamber 12 is approximately 150°. Inner and outer chambers 30, 12 are shown held in this extended relationship by locking member 56, which is inserted and extends through the "uppermost," "left most" aperture 28 of outer chamber 12, and the "uppermost," "right most" aperture 46 of inner chamber 30.

Figure 3:
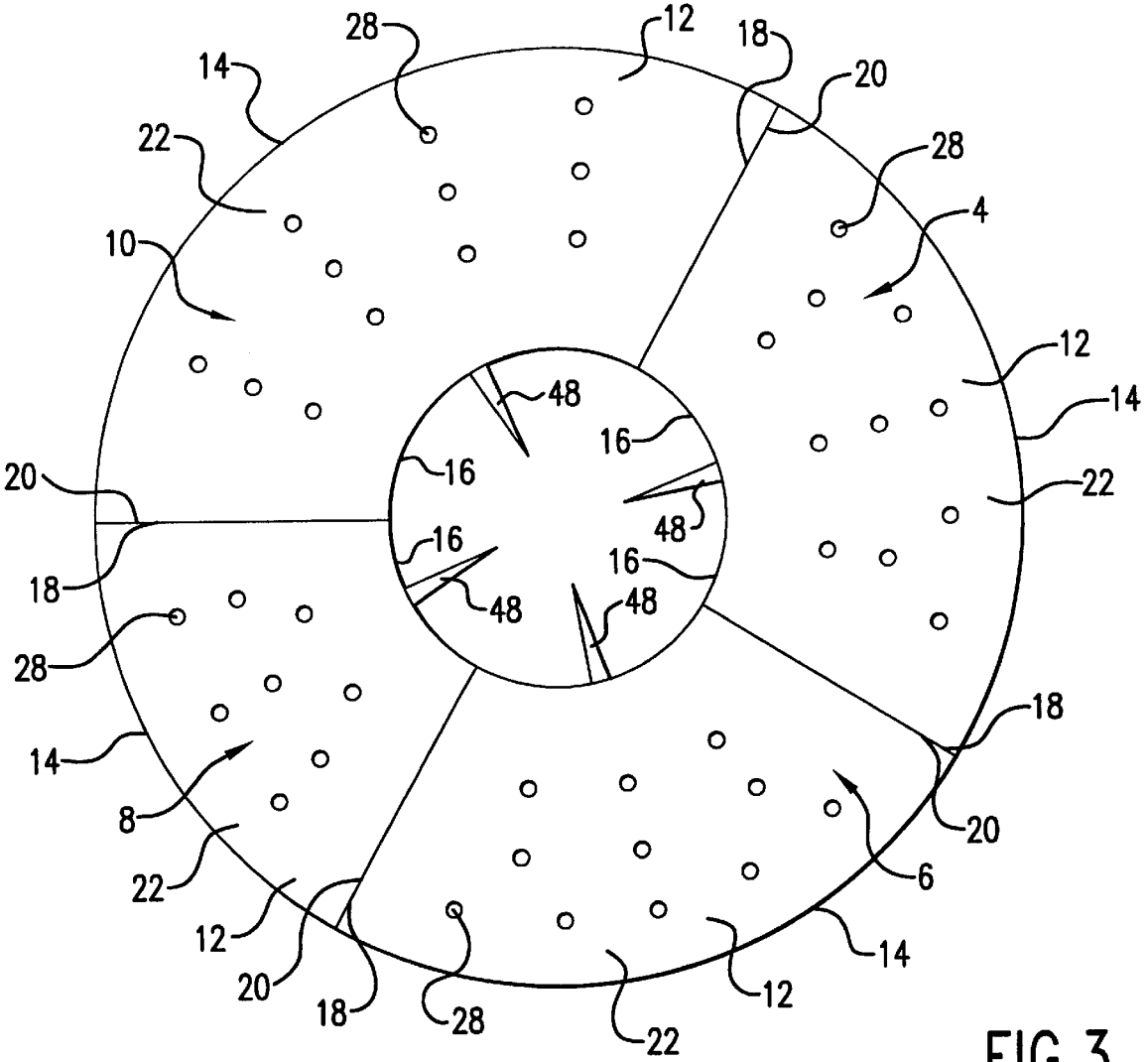
FIG. 3 is a top plan view of four separate units in accordance with the adjustable door stop of the present invention, wherein the inner chamber of each unit is fully received within the outer chamber thereof.

Referring to FIG. 3, a top plan view is shown of four separable, adjustable units labeled with the reference numbers 4, 6, 8 and 10. Each unit includes a mounting member 48 extending therefrom. For marketing or other purposes, a plurality of units may be packaged together to comprise a circle totaling 360°. Such a combination is shown in FIG. 3, wherein units 4 and 6 are each "90°" units (and are each extendable to 150° when inner chambers 30 thereof are fully extended from corresponding outer chambers 12), unit 8 is 60° (extendable to 95°), and unit 10 is 120° (extendable to 190°). The foregoing dimensions are merely illustrative of possible sizes and shapes of the units of the present invention.

The inner chamber 30 of each unit shown in FIG. 3 is completely disposed within its corresponding outer chamber 12, and the arrays of apertures 46 of each inner chamber 30 are aligned with the arrays of apertures formed in corresponding outer chambers 12. In use, multiple units of varying sizes may be used together (such as side by side) in order to achieve the desired orientation of the door. In this regard, each unit may include complementary attachment or locking members (such as male and female elements, magnets, etc.) disposed adjacent one or more of ends 18, 20, 36, 38.

The foregoing description of the preferred embodiment has been presented for purposes of illustration and description. It is not intended to be exhaustive or to limit the invention to the precise form disclosed, and obviously many modifications and variations are possible in light of the above teachings. For example, instead of adjustment means comprising apertures 46 being formed within top surface 40 of inner chamber 30, slightly raised protrusions may extend upwardly from top surface 40 of inner chamber 30, and "mate" with apertures 28 of outer chamber 12 in order to selectively adjust door stop 2. Conversely, protrusions may extend downwardly from top surface 22 of outer chamber 12 and mate with apertures 46 formed within inner chamber 30. In addition, rather than being a substantially hollow sleeve, second arm 52 of mounting member 48 may alternatively comprise a solid, pin-like structure, secured directly to or immediately adjacent a door hinge. Moreover, mounting member 48 may be releasably attached to outer chamber 12, such that unit 4 could be easily detached from a mounting member 48 which would remain on the door hinge.

In light of the foregoing, it will be appreciated that the door stop of the present invention provides numerous benefits. For example, the present invention provides, without limitation, at least the following benefits:

- adjustable nature permits the door stop to hold any hinged door in nearly any position by use of one or more of the separable units;
- may be mounted on either side of a door hinge to ensure a fixed position of corresponding door;
- is of a size and construction that will not, in normal usage, cause indentations, scratches, or other damage to the door, wall, and surrounding structure;
- may be manufactured and appropriately decorated to achieve a pleasing decor;
- can be used on each of a door's multiple (usually two or three) hinges; such use provides enhanced aesthetics as well as a positive degree of security to prevent an unauthorized opening of a door;
- useful as an emergency door security hold from inside a room when a lock malfunctions or is not trusted, a key is lost, or absolute security is required;
- serves as a safety device to prevent children and the aged from harming their fingers, such as by becoming pinched from a closing door;
- may be used to hold folding or decorative doors open by using a unit extended to 180° position, or to cause a folding door to be held in any position;
- units may be used singly or in combination to achieve the desired position;
- suitable for interior or exterior use (such as on lawn gates, shed doors, or the like);
- fully portable, no installation required;
- cost-effective design requiring simple, low-cost manufacturing process;
- universal design and function so that one size will address substantially all applications;
- out of the way when in use and does not obstruct the door passage nor interfere with cleaning, as does a conventional floor-based door stop;

effectiveness is not dependent upon the gap between the bottom of the door and the floor, as are conventional floor-based door stops;

simple to use, can be rapidly put into place.

The preferred embodiment was chosen and described in order to best explain the principles of the present invention and its practical application to thereby enable others skilled in the art to best utilize the invention in various embodiments and with various modifications as are suited for the particular use intended. It is intended that the scope of the invention be defined by the claims appended hereto.

What is claimed is:

1. An adjustable door stop in combination with a door comprising:

an outer chamber having a substantially hollow interior defined by a top surface, a bottom surface, a substantially arcuate outer surface, and a substantially arcuate inner surface offset from said outer surface;

an inner chamber at least partially disposed within said interior of said outer chamber, said inner chamber having a top surface, a bottom surface, a substantially arcuate outer surface, and a substantially arcuate inner surface offset from said outer surface;

complimentary adjustment means disposed on said top surfaces of said outer and inner chambers; and a mounting member extending from the adjustable door stop mounting the adjustable door stop to a hinge of the door.

2. The adjustable door stop of claim 1, wherein said complimentary adjustment means comprises a plurality of apertures formed within said top suface of said outer chamber.

3. The adjustable door stop of claim 2, further comprising a locking member extending through at least one of said apertures of said top surface of said outer chamber.

4. The adjustable door stop of claim 1, wherein said complimentary adjustment means comprises a plurality of apertures formed within said top surface of said inner chamber.

5. The adjustable door stop of claim 4, further comprising a locking member extending through at least one of said apertures of said top surface of said outer chamber.

6. The adustable door stop of claim 1, wherein said mounting member comprises a substantially hollow sleeve for receiving a hinge of the door.

7. An adjustable door stop in combination with a door comprising:

an outer chamber having a substantially hollow interior defined by a top surface having at least one aperture formed therein, a bottom surface, a substantially arcuate outer surface, and a substantially arcuate inner surface offset from said outer surface;

an inner chamber at least partially disposed within said interior of said outer chamber, said inner chamber having a top surface with at least one aperture formed therein, a bottom surface, a substantially arcuate outer surface, and a substantially arcuate inner surface offset from said outer surface;

a locking member disposed within and extending through said at least one aperture of said top surface of said outer chamber and said at least one aperture of said top surface of said inner chamber; and a mounting member extending from the adjustable door stop mounting the adjustable door stop to a hinge of the door.

8. The adjustable door stop of claim 7, wherein said at least one aperture of said top surface of said outer chamber comprises a plurality of apertures.

9. The adjustable door stop of claim 8, wherein said at least one aperture of said top surface of said inner chamber comprises a plurality of apertures.

10. The adjustable door stop of claim 7, wherein said mounting member comprises a substantially hollow sleeve.

* * * * *